United States Patent [19]

Yearout

[11] 4,158,556

[45] Jun. 19, 1979

[54] NITROGEN-METHANE SEPARATION PROCESS AND SYSTEM

[76] Inventor: James D. Yearout, Suite 322, 415 Herondo Ave., Hermosa Beach, Calif. 90254

[21] Appl. No.: 786,130

[22] Filed: Apr. 11, 1977

[51] Int. Cl.[2] ..... F25J 3/02

[52] U.S. Cl. ..... 62/28; 62/17; 62/39; 62/40; 62/31

[58] Field of Search ..... 62/23, 28, 27, 17, 38, 62/39, 31, 40

[56] References Cited

U.S. PATENT DOCUMENTS

| | | | |
|---|---|---|---|
| 1,878,123 | 9/1932 | Etienne | 62/31 |
| 2,499,043 | 2/1950 | Voorhees | 62/39 |
| 2,534,903 | 12/1950 | Etienne | 62/39 |
| 3,074,245 | 1/1963 | Becker | 62/17 |
| 3,130,026 | 4/1964 | Becker | 62/17 |
| 3,516,262 | 6/1970 | Bernstein | 62/28 |

*Primary Examiner*—Norman Yudkoff
*Attorney, Agent, or Firm*—Max Geldin

[57] ABSTRACT

Method and system designed particularly for separating or removing nitrogen from mixtures of nitrogen and methane, particularly natural gas, over a wide range of nitrogen concentrations, employing low temperature rectification, for recovery of methane containing a substantially reduced amount of nitrogen, either as a gas or a liquid, including the features of regenerative heat exchange to cool the feed mixture to near its saturation point, prior to introduction into a fractionating column, by-passing a small stream of the feed around the regenerative heat exchanger as a means of controlling feed temperature and reboil heat in the column, passing the overhead nitrogen gas from the column in indirect heat exchange relation with the rectifying section of the column to generate reflux continuously along the separation zone, work expansion of the nitrogen waste stream to provide necessary refrigeration, providing downflow evaporation of the liquid product within the column in the case of gas producing plants, and subcooling the bottoms liquid product prior to evaporation of the product in the case of a gas producing plant, or prior to isentropic expansion to liquid storage in the case of a liquid producing plant.

20 Claims, 2 Drawing Figures

FEED GAS
METHANOL
NITROGEN TO VENT
PRODUCT HYDROCARBON GAS
A
B

FEED
50
62
63
54
52
56
GASEOUS HYDROCARBON PRODUCT
WASTE N2
60
82
80
88
96
86
84
94
70
92
90
68
70
LIQUID HYDROCARBON PRODUCT
72
56
66
58
66
74
76
78
64

NITROGEN-METHANE SEPARATION PROCESS AND SYSTEM

BACKGROUND OF THE INVENTION

This invention relates to the separation of the components of mixtures of nitrogen and hydrocarbons, particularly mixtures of nitrogen and methane, such as natural gas, by low temperature rectification, and is particularly concerned with procedure for separation of methane containing only a small amount of nitrogen, from mixtures thereof with nitrogen, and wherein the nitrogen concentration can vary over a wide range, e.g. from 15% to more than 80%, employing non-adiabatic or differential distillation within the fractionating zone for maximum thermodynamic efficiency, and utilizing gas feed pressures significantly below the critical pressure of the mixture, e.g. below about 700 psia, thus eliminating the need for compression above natural gas reservoir pressures, and only requiring recompression of the methane or hydrocarbon gas product to the desired delivery pressure, thereby eliminating the need inieially to compress the waste nitrogen in the raw feed stock.

The separation of the components of natural gas containing low-boiling hydrocarbons and nitrogen, such as for example mixtures of methane and nitrogen as in natural gas to remove nitrogen and to recover hydrocarbon, e.g. methane, of substantially reduced nitrogen content, for use as a quality pipeline gas has become of considerable importance. It is thus desirable to provide a pipeline gas containing not more than 7% nitrogen from natural gas mixtures which can contain from 15% to more than 80% nitrogen, as efficiently as possible. It will be understood that all percentages of components of the gas compositions set forth herein are on a mol basis unless otherwise indicated.

U.S. Pat. Nos. 3,568,459 and 3,589,137 disclose processes and systems for the separation of nitrogen from mixtures of nitrogen and hydrocarbons such as methane, by low temperature rectification. However, the processes of these patents require initial compression of the feed gas mixture to high pressures of the order of about 1000 psi, and the feed gas is throttled prior to introduction into the fractionating column, which is operated at a pressure, e.g. ranging from about 100 to about 300 psi. These processes utilize pumped liquid cycles in that the product hydrocarbon such as methane is withdrawn from the fractionating column as a liquid, which is then elevated in pressure by means of a mechanical pump, e.g. at a pressure up to about 75% or more of the pressure of the feed mixture, e.g. up to 800 psi, as noted in the 3,568,459 patent, and the resulting liquid product is then evaporated in countercurrent heat exchange with the raw feed mixture. This mode of procedure requiring high compression of feed gas and high compression of hydrocarbon product, imposes operational limitations upon these systems, which reduce their efficiency and render them economically disadvantageous for use in many low BTU gas reservoirs.

Thus, in order for the process of the above noted patents to function effectively, the raw feed gas stream must be at a pressure above the critical pressure of the mixture, e.g. in excess of 705 psi. In practice, it is desirable in such systems to maintain a feed gas pressure in excess of 800 psi and particularly above 1000 psi, since minor amounts of ethane, propane and heavier hydrocarbons normally found in natural gases, sufficiently alter the thermal properties of the feed mixture as to require higher feed pressures in order for heat exchange to occur.

Normal natural gas reservoirs are initially at high pressures but the pressure gradually declines over a period of time. When employing the processes of the above patents, compression of the entire feed stream from such gas reservoir would be required, including the waste nitrogen, to the above noted relatively high pressure. This limitation is expensive both in terms of capital expenditure and in operating energy. The process and system of the present invention are designed to operate efficiently with any feed pressure and with gas mixtures having a wide range of nitrogen concentration, requiring only that the feed pressure be say five to six times greater than the product evaporation pressure. This then requires only the recompression of the hydrocarbon or methane gas to the desired delivery pressure, e.g. about 300 to about 600 psia, and eliminating the need to compress the waste nitrogen.

Another limitation in the processes and systems of the above patents results from the above noted pumped liquid cycle employed by these patents. The critical pressure of a mixture is defined as the pressure above which only a single phase exists. Separation by fractionation and partial condensation can occur only in the presence of two phases, e.g. liquid and vapor. As a result, the systems of the above noted patents render it difficult economically to separate and recover heavier hydrocarbons such as propane, butane, and the like, which are frequently more valuable than the methane constituent.

U.S. Pat. No. 3,559,418 discloses liquefaction of natural gas containing nitrogen by low temperature rectification employing a natural gas feed at relatively low pressure, e.g. up to about 400 psia. However, the patent process is designed to liquefy the feed gas employing a reduced power requirement, regardless as to the nitrogen content of the final product, which can contain up to 15% nitrogen.

BRIEF DESCRIPTION OF THE INVENTION

In its broad aspects, there is provided according to the present invention a process for the separation of nitrogen from a mixture of gases consisting essentially of a low boiling hydrocarbon, particularly methane, and nitrogen, which comprises cooling said mixture of gases as feed at a pressure substantially below the critical pressure of said mixture, by regenerative heat exchange to a temperature near the saturation point of said mixture, introducing said feed into a fractionating column operating at a pressure substantially the same as the pressure of said feed mixture, effecting a separation of said mixture in said column into a nitrogen fraction and a hydrocarbon fraction, withdrawing nitrogen as overhead from said column, work expanding the exiting overhead nitrogen and further cooling same, recycling said expanded and cooled nitrogen in heat exchange relation along the upper portion of said column to provide refrigeration therefor, passing said exiting nitrogen in heat exchange relation with said feed to provide said regenerative cooling of said feed, withdrawing said low boiling hydrocarbon liquid from the lower portion of said column, flashing at least a portion of said withdrawn liquid hydrocarbon to reduce the temperature thereof, passing said portion of said cooled flashed hydrocarbon in downflow indirect heat exchange relation along the lower portion of the rectifying section of said column to vaporize said hydrocarbon, effecting a non-adiabatic differential distillation in said column, and withdrawing hydrocarbon as product. In preferred practice vaporized hydrocarbon product is also passed in heat exchange relation with the feed to aid in providing the regenerative cooling of the feed.

According to the present invention, the raw feed stock in the form, e.g. of natural gas containing varying amounts of nitrogen, is subjected to regenerative heat exchange with cold waste nitrogen, or a combination of waste nitrogen and hydrocarbon product gas, to cool the feed to near its saturation point and the resulting cooled feed is introduced into a fractionating column, which is operated at substantially the same pressure as the feed. According to one embodiment a small by-pass stream constituting a minor portion of the feed is preferably taken around the regenerative heat exchanger and passed into heat exchange relation with the stripping section of the column to provide reboil heat therein, the resulting cooled minor feed portion then being introduced into the column, as by first mixing same with the major portion of the cooled feed prior to introduction thereof into the column. This by-pass stream provides a means of control of the feed temperature and the reboil heat in the fractionating column.

Moving upwards through the rectifying section of the column, the methane content is continuously reduced by partial condensation, until the vapor at the overhead contains virtually no hydrocarbon and is essentially nitrogen. Condensed liquid flows downwardly through the column below the point of feed introduction and liquid hydrocarbon product is removed from the bottom of the column.

The overhead nitrogen gas is passed in heat exchange relation with the rectifying section of the column to supply refrigeration thereto and to generate reflux continuously along the separation zone. The nitrogen waste stream is work expanded and further cooled, and again passed in heat exchange relation with the rectifying section of the column to provide the necessary refrigeration. Alternatively, the overhead nitrogen from the column can be directly work expanded, followed by passage in heat exchange relation with the rectifying section of the column. Further, the exiting nitrogen can be again work expanded and passed in heat exchange relation with the rectifying section of the column to provide additional refrigeration.

The liquid product from the column can be subcooled followed by evaporation in the case of a gas product producing plant, or by expansion to a liquid in the case of a liquid producing plant, such subcooling being carried out by passage of the liquid hydrocarbon product into heat exchange relation with cold waste nitrogen exiting from heat exchange relation with the rectifying section of the column.

As an additional feature particularly for gas producing plants, downflow evaporation of the liquid product by passage through the lower portion of the rectifying section of the fractionating column results in a gas product and provides the optimum temperature within the mass separation zone.

Carbon dioxide in the raw feed gas is preferably removed by employing the so-called Rectisol process, employing a refrigerated methanol system, in combination with the low temperature rectification process of the present invention. In this combination, carbon dioxide in the raw feed stream is absorbed in refrigerated methanol, and the refrigerated methanol is regenerated and stripped of the carbon dioxide using the cold methane product stream as the stripping gas. This results in various advantages including recovery of valuable hydrocarbons and delivery thereof in the product stream. The waste nitrogen from the nitrogen separation system alternatively can be used to strip the $CO_2$ from the refrigerated methanol. The refrigerated methanol purged of $CO_2$ is then recycled for absorption of additional $CO_2$ in the feed stream gas.

The process of the present invention is designed particularly for the separation of mixtures of hydrocarbons such as methane, and nitrogen, with the raw feed gas mixtures at pressures significantly below the critical pressure of the mixture, that is, not in excess of about 700 psia. The present process will function satisfactorily at any feed pressure below about 700 psia, preferably at feed pressures ranging from about 100 to about 400 psia, thereby eliminating the need for compression of the raw feed gas as the natural gas reservoir pressure declines. In addition, the invention process operates efficiently over a wide range of natural gas composition variations, wherein nitrogen content can range from as low as 15% to above 80%, the hydrocarbon product obtained having a substantially reduced nitrogen content of about 3% to about 7%.

The invention process and system employs non-adiabatic or differential distillation within the fractionation column to provide the maximum thermodynamic efficiency within the column. The invention process is readily adaptable to the production of hydrocarbon or methane product as a gas of pipeline quality, or as a liquefied natural gas product, or a combination of the two product forms.

For this purpose, two basic configurations are employed, one for raw feed mixtures containing up to 50% nitrogen, and a second configuration for feed mixtures containing in excess of 50% nitrogen.

The first configuration or modification, employed for feed mixtures containing up to 50% nitrogen, is not a complete distillation process or system, and requires only the upper section of a fractionating column, commonly called the rectifying section, to produce pipeline quality gas. The necessary reboil heat in this modification is provided by controlling the temperature of the vapor feed. The second configuration or modification, employed for raw feed gases containing in excess of 50% nitrogen, or in some instances when the natural gas product is desired as a liquid, contains all of the elements of the first configuration or modification above, with the addition of a lower section below the feed gas inlet, known as the stripping or bottoms section within the column. As a result, the feed to the midpoint of the column is a gas-liquid mixture.

The invention will be more clearly understood by reference to the detailed description below, taken in connection with the accompanying drawings wherein:

FIG. 1 is a schematic representation of a preferred form of separation system for separating nitrogen from a natural gas containing up to 50% nitrogen, according to the invention; and FIG. 2 is a schematic representation of a preferred form of separation system for removal of nitrogen from natural gas containing in excess of 50% nitrogen.

DESCRIPTION OF PREFERRED EMBODIMENTS

Figure 1:
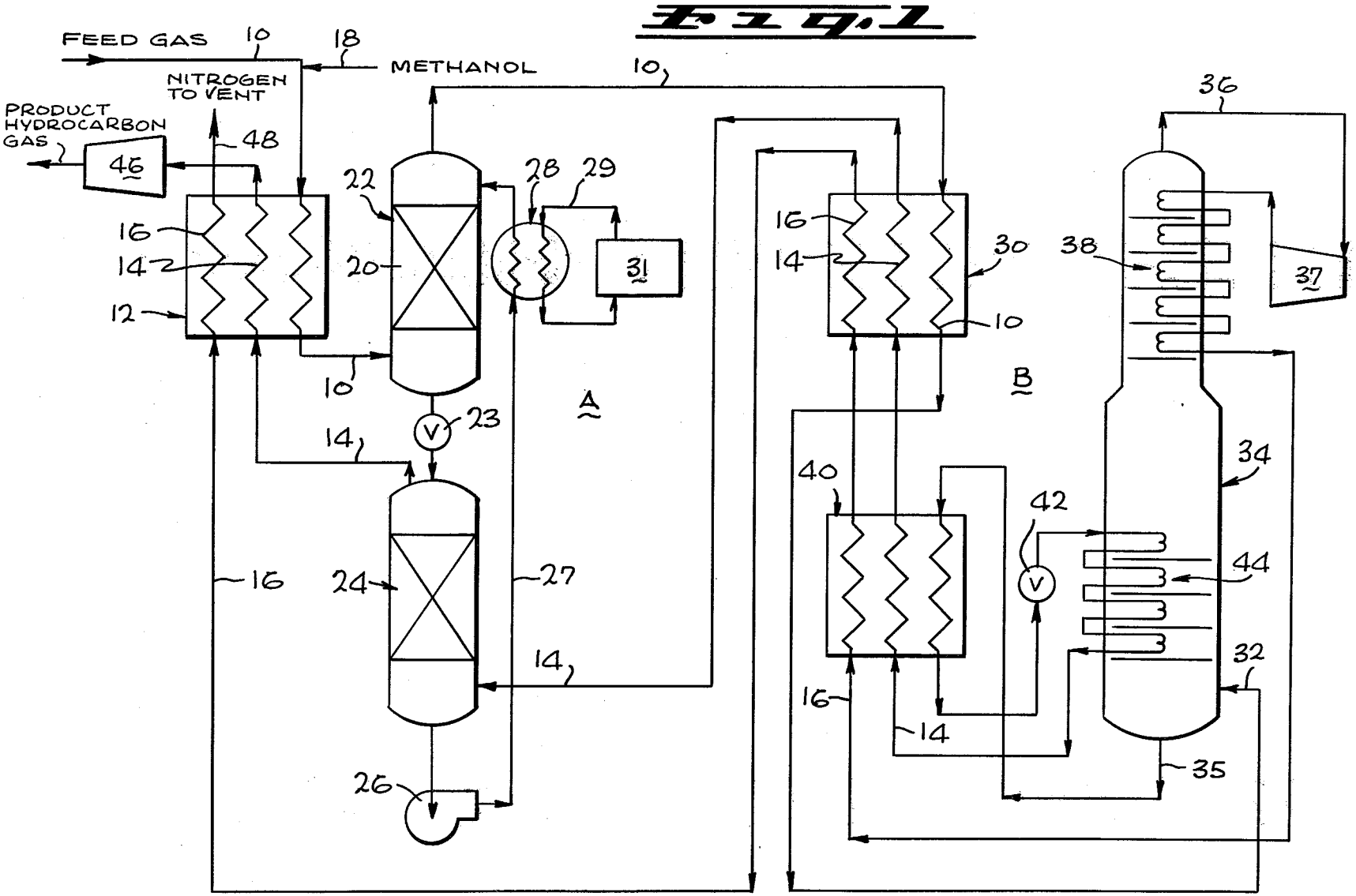
Figure 2:
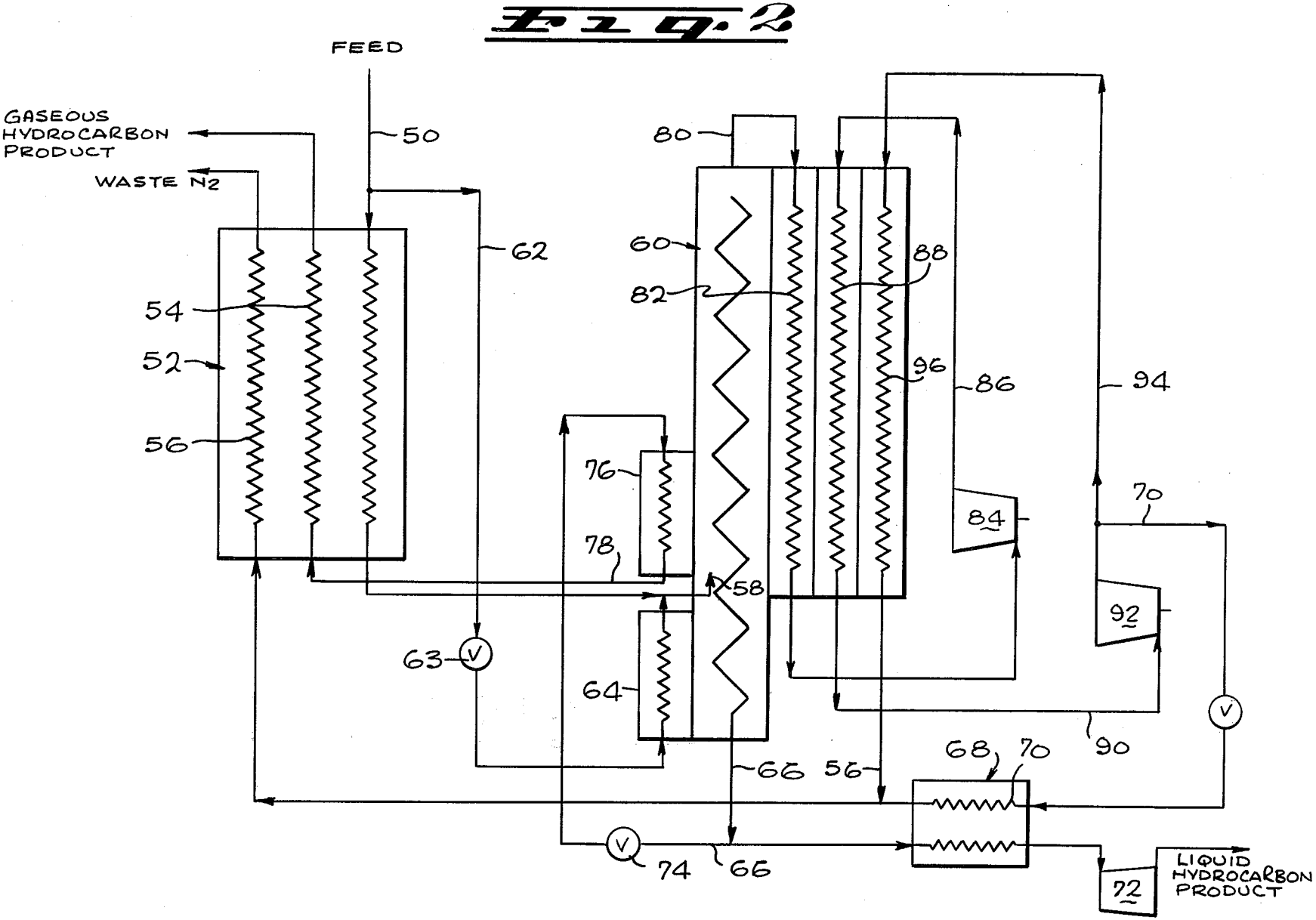

The following are examples of operation of the invention process, in connection with the embodiments of FIGS. 1 and 2 of the drawing.

EXAMPLE 1

It is desired to process a natural gas feed according to the invention for production of a pipeline quality gas that will contain not more than 3% $CO_2$ and not more than 7% nitrogen, and which possesses a gross heating value in excess of 1000 BTU per cubic foot.

Referring to FIG. 1 of the drawing, a natural gas feed mixture at 10 containing 30% nitrogen, 0.5% $CO_2$, 65% methane and the balance ethane and heavier hydrocarbons, including propane and butane, is available for processing at about 300 psia.

The raw feed gas stream 10 is first processed through a so-called Rectisol unit, indicated at A in FIG. 1, for removal particularly of the major portion of $CO_2$ in the feed gas, prior to processing in the low temperature rectification process or unit of the invention, indicated at B in FIG. 1.

The raw feed stream 10 at 300 psia pressure and 70° F. is cooled to approximately −80° F. in a heat exchanger 12 by countercurrent heat exchange with the methane product and waste gas streams 14 and 16, respectively. Prior to entering exchanger 12, a small amount of methanol at 18 is injected into the raw feed stream 10, to prevent the formation of ice from any residual moisture which may be present in the feed stream.

The resulting feed stream 10 at −80° F. is washed in countercurrent flow with refrigerated methanol 20 at −80° F., and 300 psia in an absorber unit 22 of the Rectisol system A. The $CO_2$ in the feed stream 10 is thus physically absorbed by the methanol. It is important to remove substantially all of the $CO_2$ from the hydrocarbon feed gas prior to introduction thereof into the fractionating column for separation of nitrogen, to avoid freezing of the $CO_2$ in the column and interfering with the operation of the column. The methanol containing absorbed $CO_2$ is regenerated by flashing from 300 psia to about 30 psia through valve 23, and by stripping the $CO_2$ from the resulting flashed methanol in the stripper unit 24, by passage of the methane product vapor stream 14 through the methanol in unit 24, as further described below. The resulting methanol then is pumped at 26 up to a pressure of about 300 psia and is passed via line 27 through an external heat exchanger 28 in countercurrent heat exchange with an auxiliary refrigerating stream such as Freon at 29 from the refrigerating unit 31, to reduce the temperature of the methanol stream to −80° F., and the resulting lean and cold methanol stream is then recirculated to the unit 22 for washing the feed gas mixture 10 as noted above.

The feed stream 10 exiting the washing unit 22, still at about 300 psia and −80° F. is further cooled to −155° F. by passage through heat exchanger 30 in countercurrent heat exchange relation with the methane product vapor and waste nitrogen gas streams 14 and 16 respectively, and the feed stream then enters at 32 into the lower end of a fractionating column 34. In the fractionating zone of column 34, the hydrocarbon portion of the feed stream is liquefied by successive stages of partial condensation, resulting in a non-adiabatic distillation.

The waste nitrogen containing less than 0.5% methane, is taken off as overhead vapor at 36, at the upper end of the column, at approximately 290 psia and at −252° F., while the hydrocarbon or methane product, containing approximately 6% nitrogen is collected as a liquid at the bottom of the column and withdrawn therefrom at 35 at a temperature of −180° F. and about 300 psia.

The waste nitrogen vapor at 36 is expanded by work expansion in a turbo-expander 37 to a pressure of 20 psia and a temperature of −317° F., and the resulting cold nitrogen vapor is then warmed to −255° F. by passage through heat exchanger 38 in the upper portion of the separation zone of column 54, to supply the necessary refrigeration to provide reflux in the upper portion of the rectifying section of the column 34.

The hydrocarbon liquid withdrawn at 35 from the bottom of the fractionating column 34 is further cooled to −230° F. in a heat exchanger 40, by countercurrent heat exchange with the methane product vapor and waste nitrogen streams 14 and 16, respectively, and the resulting cooled hydrocarbon stream is flashed at throttling valve 42 to a liquid at approximately 40 psia, thereby reducing its temperature to −255° F. The product liquid is then evaporated by passage through a downflow heat exchanger 44 within the lower portion of the separation zone in column 34, producing the necessary heat transfer for non-adiabatic distillation to occur. A downflow evaporation of the product fluid is essential in this embodiment, since the product mixture boils over a temperature range with the first evaporation being below the boiling point of pure methane due to the presence of small amounts of nitrogen, and the final evaporation being at a temperature above the boiling point of pure methane, due to the presence of higher boiling hydrocarbons.

The product vapor 14 exiting the downflow heat exchanger 44 and at a pressure of about 30 psia, is first warmed to −210° F. by passage through heat exchanger 40 in countercurrent heat exchange relation with the product liquid 35, and is further warmed to −97° F. by passage through heat exchanger 30 in countercurrent heat exchange with the feed stream 10. The exiting product vapor stream 14 is then used in unit 24 of the Rectisol unit A to strip the $CO_2$ from the refrigerated methanol solution, as noted above. The product steam 14, exiting the unit 24 and now carrying approximately 0.7% $CO_2$ and 5% nitrogen, is warmed to approximately 60° F. by heat exchange in heat exchanger 12 with the incoming product feed stream 10, and the exiting methane product stream 14 at 60° F. and 25 psia is then compressed at 46 to pipeline pressure of about 300 psia and about 100° F.

The waste nitrogen 16 exiting the heat exchanger 38 in the upper portion of the rectifying column 34, and at a temperature of −225° F. and 18 psia, is passed through heat exchangers 40 and 30, for cooling the bottoms product liquid 35 and the feed stream 10, and the warmed nitrogen at −97° F. and at 16 psia leaving exchanger 30, is then passed through heat exchanger 12 for initial cooling of feed stream 10, and is withdrawn at 48, at 60° F. and 15 psia (atmospheric pressure.)

When the content of $CO_2$ in the feed gas is less than 3%, it is preferred to employ the hydrocarbon product gas for stripping the absorbed $CO_2$ from the refrigerated methanol, as described above and shown in FIG. 1. When the content of $CO_2$ in the feed gas is about 3% or above, it is preferred to employ the cold waste nitrogen stream, as at 16 in FIG. 1, rather than the product gas stream 14 for stripping $CO_2$ from the methanol solution. Further, when it is desired to obtain waste nitrogen as a marketable product, it is preferred to employ the hydrocarbon product stream for methanol stripping, if the amount of $CO_2$ in the feed stream is not excessive, since it would be desirable not to have $CO_2$ in the nitrogen product.

The methanol solution is refrigerated by the cold hydrocarbon product stream or the cold nitrogen stream, as at 14 and 16, respectively, used to strip the methanol solution of $CO_2$, both of which streams are at −97° F. in the above example. Initially, an external source of refrigeration as at 29 in FIG. 1, is used to refrigerate the methanol solution. However, once the methanol solution has reached a steady cold state, external refrigeration may no longer be necessary, since once the stripping gas stream is available at a temperature below the operating temperature of the Rectisol absorber 22, e.g. −80° F., the external refrigerant shown at 29 is no longer required, and the refrigerating unit at 31 can be shut off.

It will be understood that in place of the Rectisol system described above and indicated at A in FIG. 1, other methods can be employed for removal of $CO_2$ from the feed gas stream 10. These alternative $CO_2$ removal methods include, for example the use of molecular sieves or ethanolamine solution. However, the refrigerated methanol system, known as the Rectisol process, offers certain advantages when employed in combination with the basic process of the invention, one embodiment of which is illustrated at B in FIG. 1 of the drawing. Such combination results in a substantially different mode of operation than the usual application of the Rectisol process. Thus, when employing such combination, hydrocarbons heavier than ethane are absorbed by the methanol. By using the product stream for stripping the methanol, valuable hydrocarbons including ethane and heavier hydrocarbons are recovered and delivered in the product stream. Another advantage is that the heavy hydrocarbon content of the feed stream to the nitrogen removal portion of the low temperature rectification process illustrated at B, is stabilized in that the concentration of propane and heavier hydrocarbons remains constant in the Rectisol absorber overhead hydrocarbon stream, regardless of small variations in hydrocarbon content of the feed gas, resulting in a more efficient operation of the distillation process. In addition, the expansion of the waste nitrogen in the basic separation process of the invention provides additional refrigeration for use in the refrigerated methanol or Rectisol process.

EXAMPLE 2

The following example describes an embodiment of the invention capable of producing both liquid and gaseous hydrocarbon products from a natural gas feed stream containing in excess of 50% nitrogen, illustrated in FIG. 2 of the drawing.

A hydrocarbon feed stream 50 at −80° F. and 300 psia, from which water vapor and carbon dioxide have been previously removed as by any of the means noted above, and containing 82% nitrogen, the balance being hydrocarbon gas, principally methane, is passed in countercurrent heat exchange relation in heat exchanger 52, with a gaseous hydrocarbon product stream 54 and a waste nitrogen stream 56. The resulting feed stream 50 exiting the heat exchanger 52 is cooled to near the saturation point of the mixture, approximately −225° F., and is introduced at 58 as a vapor into a fractionating column 60.

A small portion, e.g. about 5 to about 10% of the feed at 62, bypasses the heat exchanger 52, is throttled at 63, and is cooled by passing in indirect heat exchange relation at 64 with the lower portion or stripping section of the column 60. The passage of the by-passed vapor 62 in heat exchange relation with the stripping section of the column provides heat therein for reboil. The resulting cooled and by-passed portion of the feed at −225° F. is mixed with the cooled feed at 50 for introduction into the column at 58.

The liquid product withdrawn from the lower end of the column at 66, and still at 300 psia and at −175° F. contains 5% nitrogen, with the balance being hydrocarbon. It will be noted that liquid in equilibrium with the vapor feed at 58 contains 37% nitrogen, thus demonstrating the need for the stripping section.

If liquid product is required, liquid is withdrawn from the column bottoms at 66, cooled in a product subcooler 68 in countercurrent heat exchange with expanded waste nitrogen at 70 to approximately −232° F., and is then isentropically expanded in the liquid expander 72 from 300 psia to the desired storage pressure, e.g. about 30 psia. Such isentropic expansion of the product liquid provides a portion of the refrigeration required to produce the product as a liquid. Thus, for the particular feed mixture composition noted above, isentropic expansion of the product liquid supplies approximately 11% of the total refrigeration required by the process.

If gaseous product is desired, the liquid bottoms product at 66 is reduced in pressure by throttling at 74 to approximately 40 psia, resulting in a temperature of about −250° F., and is evaporated by passage through a downflow evaporator 76, thus aiding in providing reflux in the upper or rectifying section of the column 60, by indirect heat exchange. The hydrocarbon vapor product at 78, warmed to about −235° F. is then passed in countercurrent heat exchange relation in heat exchanger 52, with the raw feed mixture 50, to aid in cooling same.

Nitrogen, containing less than 0.1% hydrocarbon, leaves as overhead at 80 from the distillation column 60, at approximately −252° F. and 300 psia. Such waste nitrogen is first passed in heat exchange relation at 82 with the upper portion or rectifying section of the fractionating column 60, and is then isentropically expanded at turbo-expander 84 of a two stage expansion operation, to −295° F. and about 66 psia, and the resulting nitrogen stream at 86 is then again passed in heat exchange relation at 88 with the upper portion of the fractionating column 60. The exiting nitrogen stream at 90 is then isentropically expanded at turbine 92 to approximately −315° F. and the resulting expanded nitrogen stream at 94 is again passed at 96 in countercurrent heat exchange relation with the upper portion of the fractionating column 60, the waste nitrogen streams 82, 88 and 96 providing the necessary reflux in the upper rectifying section of column 60, by indirect heat exchange relation with the distillation zone.

The waste nitrogen stream 56 at approximately −235° F. and 20 psia exiting the heat exchanger 96 is passed in heat exchange relation in heat exchanger 52 with the raw feed stream 50 for cooling same. A portion of the waste nitrogen feed stream discharged from the second turbine 92 can be passed at 70 through the subcooler 68 for cooling the liquid product stream 66 in the product subcooler 68.

It is seen that the system shown in FIG. 2 includes multiple pass heat exchange for the waste nitrogen, at 82, 88 and 96, with respect to the upper portion of the fractionating column, and multiple waste nitrogen expansion at 84 and 92. This arrangement is preferred when it is desired to extract the maximum amount of refrigeration from the nitrogen waste stream. This condition is preferably utilized principally when liquid product is desired. When less refrigeration is required, for example when the desired product is primarily gas, a simpler arrangement of single expansion and a single heat exchange pass within the separation zone, as illustrated in Example 1 and FIG. 1 of the drawing, can be employed.

It will be seen that the unit of FIG. 2 can be employed either for production of liquid methane product, gaseous methane product, or both liquid and gaseous methane products.

It is noted from the above that the invention process employs as features thereof work expansion of the overhead waste nitrogen and utilization thereof in the uppermost portion of the fractionating zone to affect non-adiabatic distillation of the overhead mixture, so that when the maximum cooling has been extracted from the waste nitrogen stream the temperature at that point in the column will be substantially higher than the temperature in the uppermost portion of the column, and subcooling of liquid product, and throttling thereof to a lower pressure followed by evaporation of such liquid in downflow heat exchange relation in the lower portion of the rectifying section of the column. The net effect of this specific combination of steps is to permit the hydrocarbon product to be evaporated at a relatively high pressure so that for a mixture containing 30% nitrogen and 70% methane, this pressure can be for example 75 psia, thus resulting in the requirement of a substantially reduced amount of energy for recompression of the product vapor.

The application of available refrigeration in the most advantageous locations along the distillation zone is important in order to operate in the most efficient non-adibatic manner, when even relatively small amounts of ethane and heavier hydrocarbons are present in the raw feed, since these components significantly alter the boiling characteristics of the mixture, increasing the boiling temperature and thereby reducing the pressure at which the mixture must be evaporated. Thus it is noted that in the embodiment of FIG. 1, for production of hydrocarbon gas as product, work expanded nitrogen is passed in indirect heat exchange relation along only the upper portion of the rectifying section of the column, for most efficient operation, and in the embodiment of FIG. 2, for production of liquid hydrocarbon product, the overhead and work expanded nitrogen is passed in indirect heat exchange relation along substantially the entire rectifying section of the column, for most efficient operation. However, in either case, the isentropically expanded nitrogen passed in heat exchange relation with the column, provides all of the necessary refrigeration for the column.

From the foregoing, it is seen that the invention provides for the efficient separation of nitrogen from mixtures thereof with methane, as in natural gas, over widely varying concentrations of nitrogen in such mixtures, for production of either gaseous and/or liquid product, by an efficient non-adiabatic distillation process, utilizing substantially reduced feed gas pressures.

While I have described particular embodiments of my invention for the purpose of illustration, it should be understood that various additional modifications and adaptations thereof may be made within the spirit of the invention, and the invention is not to be taken as limited except by the scope of the appended claims.

What is claimed is:

1. A process for the separation of nitrogen from a mixture of gases consisting essentially of a low boiling hydrocarbon and nitrogen, which comprises cooling said mixture of gases as feed at a pressure substantially below the critical pressure of said mixture, by regenerative heat exchange to a temperature near the saturation point of said mixture, introducing said feed into a fractionating column containing a single fractionation zone operating at a pressure substantilly the same as the pressure of said feed mixture, effecting a separation of said mixture in said column into a nitrogen fraction and a hydrocarbon fraction, withdrawing nitrogen as overhead from said column, work expanding the overhead nitrogen and further cooling same, recycling said expanding and cooled nitrogen in heat exchange relation along the upper portion of said column to provide refrigeration therefor, passing said exiting nitrogen in heat exchange relation with said feed to provide said regenerative cooling of said feed, withdrawing said low boiling hydrocarbon as liquid from the lower portion of said column, flashing at least a portion of said withdrawn liquid hydrocarbon to reduce the temperature thereof, passing said portion of said cooled flashed hydrocarbon in downflow indirect heat exchange relation along the lower portion of the rectifying section of said column to vaporize said hydrocarbon, effecting a non-adiabatic differential distillation in said column, and withdrawing hydrocarbon as product, and including by-passing a minor portion of the feed prior to cooling thereof by regenerative heat exchange, and passing said by-passed portion of said feed in heat exchange relation with the stripping section of said column, and introducing the resulting cooled minor portion of the feed into said fractionating column.

2. The process as defined in claim 1, including initially passing the feed gas mixture into refrigerated methanol for removal of $CO_2$ from said feed mixture by absorption of said $CO_2$ in said methanol, and stripping said $CO_2$ from said methanol for regeneration thereof, by passing said vaporized hydrocarbon through said $CO_2$-containing methanol.

3. The process as defined in claim 1, including initially passing the feed gas mixture into refrigerated methanol for removal of $CO_2$ from said feed mixture by absorption of said $CO_2$ in said methanol, and stripping said $CO_2$ from said methanol for regeneration thereof, by passing said nitrogen exiting from heat exchange relation with said column through said $CO_2$-containing methanol.

4. The process as defined in claim 1, including also passing said hydrocarbon vapor in heat exchange relation with said feed to provide said regenerative cooling of said feed.

5. The process as defined in claim 1, wherein said cooled minor portion of the feed is first mixed with a major portion of the cooled feed following regenerative cooling thereof, and prior to introduction thereof into said column.

6. The process as defined in claim 1, including again work expanding said exiting nitrogen and further cooling same, and again recycling said further expanded and cooled nitrogen in heat exchange relation along the upper portion of said column to provide further refrigeration therefor.

7. A process for the separation of nitrogen from a mixture of gases consisting essentially of methane and about 15 to about 80 mol % nitrogen, said methane-nitrogen feed mixture being at a pressure ranging from about 100 to about 400 psia, which comprises cooling said mixture of gases as feed at a pressure substantially below the critical pressure of said mixture, by regenerative heat exchange to a temperature near the saturation point of said mixture, introducing said feed into a fractionating column operating at a pressure substantially the same as the pressure of said feed mixture, effecting a separation of said mixture in said column into a nitrogen fraction and a methane fraction, withdrawing nitrogen as overhead from said column, work expanding the overhead nitrogen and further cooling same, recycling said expanded and cooled nitrogen in heat exchange relation along only the upper portion of said column to provide refrigeration therefor, passing said exiting nitrogen in heat exchange relation with said feed to provide said regenerative cooling of said feed, withdrawing liquid methane from the lower portion of said column, flashing at least a portion of said withdrawn liquid methane to reduce the temperature thereof, passing said portion of said cooled flashed liquid methane in downflow indirect heat exchange relation along the lower portion of the rectifying section of said column to vaporize said liquid methane, effecting a non-adiabatic differential distillation in said column, and withdrawing vaporized methane as product, including passing said methane-nitrogen feed mixture into regenerative heat exchange relation with both cold waste nitrogen and vaporized methane product for cooling said methane-nitrogen feed mixture, passing the cooled methane-nitrogen mixture into refrigerated methanol for removal of $CO_2$ from said feed mixture by absorption of said $CO_2$ in said methanol, and stripping said $CO_2$ from said methanol for regeneration thereof, by passing vaporized methane produce through said $CO_2$- containing methanol, and recycling said stripped methanol for further absorption of $CO_2$ in said feed gas mixture, further cooling said feed mixture by countercurrent heat exchange with vaporized methane product and waste nitrogen, prior to introduction of said methane-nitrogen mixture into said column, and passing all of the liquid methane withdrawn from the lower portion of said column downwardly into countercurrent heat exchange relation with vaporized methane withdrawn from heat exchange relation with the lower portion of the rectifying section of said column, and with waste nitrogen exiting from heat exchange relation with the upper portion of said column, prior to said flashing said liquid methane.

8. A process for the separation of nitrogen from a mixture of gases consisting essentially of a low boiling hydrocarbon and nitrogen, which comprises cooling said mixture of gases as feed at a pressure substantially below the critical pressure of said mixture, by regenerative heat exchange to a temperature near the saturation point of said mixture, introducing said feed into a fractionating column containing a single fractionation zone operating at a pressure substantially the same as the pressure of said feed mixture, effecting a separation of said mixture in said column into a nitrogen fraction and a hydrocarbon fraction, withdrawing nitrogen as overhead from said column, work expanding the overhead nitrogen and further cooling same, recycling said expanded and cooled nitrogen in heat exchange relation along the upper portion of said column to provide refrigeration therefor, passing said exiting nitrogen in heat exchange relation with said feed to provide said regenerative cooling of said feed, withdrawing said low boiling hydrocarbon as liquid from the lower portion of said column, flashing at least a portion of said withdrawn liquid hydrocarbon to reduce the temperature thereof, passing said portion of said cooled flashed hydrocarbon in downflow indirect heat exchange relation along the lower portion of the rectifying section of said column to vaporize said hydrocarbon, effecting a non-adiabatic differential distillation in said column, and withdrawing hydrocarbon as product, and including subcooling the remaining portion of said liquid hydrocarbon withdrawn from said column by passing said liquid hydrocarbon in heat exchange relation with the cold nitrogen exiting from heat exchange relation with the upper portion of said column, and expanding said subcooled hydrocarbon to a liquid product or evaporating said subcooled hydrocarbon to a gas product.

9. A process for the separation of nitrogen from a mixture of gases consisting essentially of a low boiling hydrocarbon and nitrogen, which comprises cooling said mixture of gases as feed at a pressure substantially below the critical pressure of said mixture, by regenerative heat exchange to a temperature near the saturation point of said mixture, introducing said feed into a fractionating column containing a single fractionation zone operating at a pressure substantially the same as the pressure of said feed mixture, effecting a separation of said mixture in said column into a nitrogen fraction and a hydrocarbon fraction, withdrawing nitrogen as overhead from said column, work expanding the overhead nitrogen and further cooling same, recycling said expanded and cooled nitrogen in heat exchange relation along the upper portion of said column to provide refrigeration therefor, passing said exiting nitrogen in heat exchange relation with said feed to provide said regenerative cooling of said feed, withdrawing said low boiling hydrocarbon as liquid from the lower portion of said column, flashing at least a portion of said withdrawn liquid hydrocarbon to reduce the temperature thereof, passing said portion of said cooled flashed hydrocarbon in downflow indirect heat exchange relation along the lower portion of the rectifying section of said column to vaporize said hydrocarbon, effecting a non-adiabatic differential distillation in said column, and withdrawing hydrocarbon as product, and including passing said at least a portion of said withdrawn hydrocarbon prior to flashing thereof, into countercurrent heat exchange relation with vaporized hydrocarbon withdrawn from downflow heat exchange relation with the rectifying section of said column, and with exiting cold nitrogen withdrawn from heat exchange relation with the upper portion of said column.

10. The process as defined in claim 9, wherein said feed gas mixture consists essentially of said low boiling hydrocarbon and about 15 to about 80 mol % nitrogen, and said feed gas mixture being at a pressure not in excess of about 700 psia.

11. The process as defined in claim 10, wherein said low boiling hydrocarbon is methane, and said methane-nitrogen feed mixture is at a pressure ranging from about 100 to about 400 psia.

12. A process for the separation of nitrogen from a mixture of gases consisting essentially of a low boiling hydrocarbon and nitrogen, which comprises cooling said mixture of gases as feed at a pressure substantially below the critical pressure of said mixture, by regenerative heat exchange to a temperature near the saturation point of said mixture, introducing said feed into a fractionating column containing a single fractionation zone operating at a pressure substantially the same as the pressure of said feed mixture, effecting a separation of said mixture in said column into a nitrogen fraction and a hydrocarbon fraction, withdrawing nitrogen as overhead from said column, work expanding the overhead nitrogen and further cooling same, recycling said expanded and cooled nitrogen in heat exchange relation along the upper portion of said column to provide refrigeration therefor, passing said exiting nitrogen in heat exchange relation with said feed to provide said regenerative cooling of said feed, withdrawing said low boiling hydrocarbon as liquid from the lower portion of said column, flashing at least a portion of said withdrawn liquid hydrocarbon to reduce the temperature thereof, passing said portion of said cooled flashed hydrocarbon in downflow indirect heat exchange relation along the lower portion of the rectifying section of said column to vaporize said hydrocarbon, effecting a nonadiabatic differential distillation in said column, and withdrawing hydrocarbon as product, and including initially passing the feed gas mixture into refrigerated methanol for removal of $CO_2$ from said feed mixture by absorption of said $CO_2$ in said methanol, and stripping said $CO_2$ from said methanol for refrigeration thereof, by passing said vaporized hydrocarbon through said $CO_2$-containing methanol.

13. A process for the separation of nitrogen from a mixture of gases consisting essentially of a low boiling hydrocarbon and nitrogen, which comprises cooling said mixture of gases as feed at a pressure substantially below the critical pressure of said mixture, by regenerative heat exchange to a temperature near the saturation point of said mixture, introducing said feed into a fractionating column containing a single fractionation zone operating at a pressure substantially the same as the pressure of said feed mixture, effecting a separation of said mixture in said column into a nitrogen fraction and a hydrocarbon fraction, withdrawing nitrogen as overhead from said column, work expanding the overhead nitrogen and further cooling same, recycling said expanded and cooled nitrogen in heat exchange relation along the upper portion of said column to provide refrigeration therefor, passing said exiting nitrogen in heat exchange relation with said feed to provide said regenerative cooling of said feed, withdrawing said low boiling hydrocarbon as liquid from the lower portion of said column, flashing at least a portion of said withdrawn liquid hydrocarbon to reduce the temperature thereof, passing said portion of said cooled flashed hydrocarbon in downflow indirect heat exchange relation along the lower portion of the rectifying section of said column to vaporize said hydrocarbon, effecting a nonadiabatic differential distillation in said column, and withdrawing hydrocarbon as product, and including initially passing the feed gas mixture into refrigerated methanol for removal of $CO_2$ from said feed mixture by absorption of said $CO_2$ in said methanol, and stripping said $CO_2$ from said methanol for refrigeration thereof, by passing said nitrogen exiting from heat exchange relation with said column through said $CO_2$-containing methanol.

14. A process for the separation of nitrogen from a mixture of gases consisting essentially of a low boiling hydrocarbon and nitrogen, which comprises cooling said mixture of gases as feed at a pressure substantially below the critical pressure of said mixture, by regenerative heat exchange to a temperature near the saturation point of said mixture, introducing said feed into a fractionating column containing a single fractionation zone operating at a pressure substantially the same as the pressure of said feed mixture, effecting a separation of said mixture in said column into a nitrogen fraction and a hydrocarbon fraction, withdrawing nitrogen as overhead from said column, work expanding the overhead nitrogen and further cooling same, recycling said expanded and cooled nitrogen in heat exchange relation along the upper portion of said column to provide refrigeration therefor, passing said exiting nitrogen in heat exchange relation with said feed to provide said regenerative cooling of said feed, withdrawing said low boiling hydrocarbon as liquid from the lower portion of said column, flashing at least a portion of said withdrawn liquid hydrocarbon to reduce the temperature thereof, passing said portion of said cooled flashed hydrocarbon in downflow indirect heat exchange relation along the lower portion of the rectifying section of said column to vaporize said hydrocarbon, effecting a nonadiabatic differential distillation in said column, and withdrawing hydrocarbon as product, wherein said feed gas mixture consists essentially of said low boiling hydrocarbon and about 15 to about 80 mol % nitrogen, and wherein said low boiling hydrocarbon is methane, and said methane-nitrogen feed mixture is at a pressure ranging from about 100 to about 400 psia, and including passing said methane-nitrogen feed mixture into regenerative heat exchange relation with both vaporized methane product and cold waste nitrogen withdrawn from heat exchange relation with the upper portion of said column, by-passing a minor portion of the feed mixture prior to cooling thereof by said regenerative heat exchange, passing said minor portion of feed gas in heat exchange relation with the stripping section of said column, and introducing the resulting cooled minor portion of the feed mixture together with the main portion of said feed mixture cooled by said regenerative heat exchange, into said fractionating column, passing said overhead nitrogen in heat exchange relation with the upper portion of said column prior to said work expanding said overhead nitrogen, again work expanding said nitrogen following said recycling said initially work expanded nitrogen in heat exchange relation along said column, and again recycling said further expanded and cooled nitrogen in heat exchange relation along the upper portion of said column to provide further refrigeration therefor, subcooling a portion of the liquid methane withdrawn from said column by passing said liquid methane in heat exchange relation with said nitrogen exiting from heat exchange relation with the upper portion of said column, and isentropically expanding said subcooled methane to a liquid methane product, flashing the remainder of said withdrawn methane liquid to reduce the temperature thereof, passing said flashed methane in said downflow indirect heat exchange relation along the lower portion of the rectifying section of said column to vaporize said methane, and recovering said vaporized methane as product.

15. A system for the separation of nitrogen from a mixture of gases consisting essentially of a low boiling hydrocarbon and nitrogen, which comprises regenerative heat exchange means for cooling said mixture of gases as feed at a pressure substantially below the critical pressure of said mixture, a fractionating column containing a single fractionation zone, means for introducing the cooled gas mixture into said column, to effect a separation of said mixture in said column into a nitrogen fraction and a hydrocarbon fraction, means for work expanding the overhead nitrogen and further cooling same, means for passing the expanded cooled nitrogen downwardly in heat exchange relation along the upper portion of said fractionating column, means for passing the exiting nitrogen through said regenerative heat exchange means for cooling said mixture of gases, means for withdrawing low boiling hydrocarbon as liquid from the lower portion of said column, means for flashing at least a portion of said withdrawn liquid hydrocarbon to reduce the temperature thereof and means for conducting said cooled flashed hydrocarbon in downflow indirect heat exchange relation along the lower portion of the rectifying section of said column to vaporize said hydrocarbon, and means for withdrawing hydrocarbon as product, and including by-pass means for by-passing a minor portion of the feed around said regenerative heat exchange means, and means for conducting said by-passed portion of said feed in heat exchange relation with the stripping section of said column, and means for introducing the resulting cooled minor portion of the feed into said fractionating column.

16. The system as defined in claim 15, including means for also passing said hydrocarbon vapor in heat exchange relation with said feed to provide said regenerative cooling of said feed.

17. A system for the separation of nitrogen from a mixture of gases consisting essentially of a low boiling hydrocarbon and nitrogen, which comprises regenerative heat exchange means for cooling said mixture of gases as feed at a pressure substantially below the critical pressure of said mixture, a fractionating column containing a single fractionation zone, means for introducing the cooled gas mixture into said column, to effect a separation of said mixture in said column into a nitrogen fraction and a hydrocarbon fraction, means for work expanding the overhead nitrogen and further cooling same, means for passing the expanded cooled nitrogen downwardly in heat exchange relation along the upper portion of said fractionating column, means for passing the exiting nitrogen through said regenerative heat exchange means for cooling said mixture of gases, means for withdrawing low boiling hydrocarbon as liquid from the lower portion of said column, means for flashing at least a portion of said withdrawn liquid hydrocarbon to reduce the temperature thereof and means for conducting said cooled flashed hydrocarbon in downflow indirect heat exchange relation along the lower portion of the rectifying section of said column to vaporize said hydrocarbon, and means for withdrawing hydrocarbon as product, and including subcooling means for subcooling the remaining portion of said liquid hydrocarbon withdrawn from said column, including means for passing cold nitrogen exiting from heat exchange relation with the upper portion of said column, in heat exchange relation with said liquid hydrocarbon in said subcooling means, and means for expanding said subcooled hydrocarbon to a liquid product or evaporating said subcooled hydrocarbon to a gas product.

18. A system for the separation of nitrogen from a mixture of gases consisting essentially of a low boiling hydrocarbon and nitrogen, which comprises regenerative heat exchange means for cooling said mixture of gases as feed at a pressure substantially below the critical pressure of said mixture, a fractionating column containing a single fractionation zone, means for introducing the cooled gas mixture into said column, to effect a separation of said mixture in said column into a nitrogen fraction and a hydrocarbon fraction, means for work expanding the overhead nitrogen and further cooling same, means for passing the expanded cooled nitrogen downwardly in heat exchange relation along the upper portion of said fractionating column, means for passing the exiting nitrogen through said regenerative heat exchange means for cooling said mixture of gases, means for withdrawing low boiling hydrocarbon as liquid from the lower portion of said column, means for flashing at least a portion of said withdrawn liquid hydrocarbon to reduce the temperature thereof and means for conducting said cooled flashed hydrocarbon in downflow indirect heat exchange relation along the lower portion of the rectifying section of said column to vaporize said hydrocarbon, and means for withdrawing hydrocarbon as product, and including means for passing the feed gas mixture into refrigerated methanol for removal of $CO_2$ from said feed mixture by absorption in said methanol, and means for stripping said $CO_2$ from said methanol for regeneration thereof, said stripping means including means for passing said vaporized hydrocarbon through said $CO_2$-containing methanol.

19. A process for the separation of nitrogen from a mixture of gases consisting essentially of a low boiling hydrocarbon and nitrogen, which comprises cooling said mixture of gases as feed at a pressure substantially below the critical pressure of said mixture, by regenerative heat exchange to a temperature near the saturation point of said mixture, introducing said feed into a fractionating column containing a single fractionation zone operating at a pressure substantially the same as the pressure of said feed mixture, effecting a separation of said mixture in said column into a nitrogen fraction and a hydrocarbon fraction, withdrawing nitrogen as overhead from said column, work expanding the overhead nitrogen and further cooling same, recycling said expanded and cooled nitrogen in heat exchange relation along the upper portion of said column to provide refrigeration therefor, passing said exiting nitrogen in heat exchange relation with said feed to provide said regenerative cooling of said feed, withdrawing said low boiling hydrocarbon as liquid from the lower portion of said column, flashing at least a portion of said withdrawn liquid hydrocarbon to reduce the temperature thereof, passing said portion of said cooled flashed hydrocarbon in downflow indirect heat exchange relation along the lower portion of the rectifying section of said column to vaporize said hydrocarbon, effecting a non-adiabatic differential distillation in said column, and withdrawing hydrocarbon as product, and including again work expanding said exiting nitrogen and further cooling same, and again recycling said further expanded and cooled nitrogen in heat exchange relation along the upper portion of said column to provide further refrigeration therefor, and also including initially passing the feed gas mixture into refrigerated methanol for removal of $CO_2$ from said feed mixture by absorption of said $CO_2$ in said methanol, and stripping said $CO_2$ from said methanol for regeneration thereof, by passing said vaporized hydrocarbon through said $CO_2$-containing methanol.

20. A process for the separation of nitrogen from a mixture of gases consisting essentially of a low boiling hydrocarbon and nitrogen, which comprises cooling said mixture of gases as feed at a pressure substantially below the critical pressure of said mixture, by regenerative heat exchange to a temperature near the saturation point of said mixture, introducing said feed into a fractionating column containing a single fractionation zone operating at a pressure substantially the same as the pressure of said feed mixture, effecting a separation of said mixture in said column into a nitrogen fraction and a hydrocarbon fraction, withdrawing nitrogen as overhead from said column, work expanding the overhead nitrogen and further cooling same, recycling said expanded and cooled nitrogen in heat exchange relation along the upper portion of said column to provide refrigeration therefor, passing said exiting nitrogen in heat exchange relation with said feed to provide said regenerative cooling of said feed, withdrawing said low boiling hydrocarbon as liquid from the lower portion of said column, flashing at least a portion of said withdrawn liquid hydrocarbon to reduce the temperature thereof, passing said portion of said cooled flashed hydrocarbon in downflow indirect heat exchange relation along the lower portion of the rectifying section of said column to vaporize said hydrocarbon, effecting a non-adiabatic differential distillation in said column, and withdrawing hydrocarbon as product, including again work expanding said exiting nitrogen and further cooling same, and again recycling said further expanded and cooled nitrogen in heat exchange relation along the upper portion of said column to provide further refrigeration thereof, and also including initially passing the feed gas mixture into refrigerated methanol for removal of $CO_2$ from said feed mixture by absorption of said $CO_2$ in said methanol, and stripping said $CO_2$ from said methanol for regeneration thereof, by passing said nitrogen exiting from heat exchange relation with said column through said $CO_2$-containing methanol.

* * * * *